US008269642B2

(12) United States Patent
Morita et al.

(10) Patent No.: US 8,269,642 B2
(45) Date of Patent: Sep. 18, 2012

(54) ALARM SYSTEM AND ALARM DEVICE

(75) Inventors: Hidesato Morita, Tokyo (JP); Makoto Masuyama, Tokyo (JP); Toshimitsu Watanabe, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 425 days.

(21) Appl. No.: 12/629,276

(22) Filed: Dec. 2, 2009

(65) Prior Publication Data

US 2010/0141461 A1 Jun. 10, 2010

(30) Foreign Application Priority Data

Dec. 5, 2008 (JP) ..... 2008-310650

(51) Int. Cl.
*G08B 21/00* (2006.01)

(52) U.S. Cl. ..... 340/636.15; 340/636.1; 340/539.1

(58) Field of Classification Search ..... 340/636.15, 340/636.1, 539.1
See application file for complete search history.

(56) References Cited

U.S. PATENT DOCUMENTS 4,531,114 A * 7/1985 Topol et al. ..... 340/539.1
6,028,513 A * 2/2000 Addy ..... 340/539.16
6,144,310 A * 11/2000 Morris ..... 340/692
6,614,347 B2 * 9/2003 Tanguay ..... 340/508
2011/0018705 A1 * 1/2011 Egawa et al. ..... 340/539.1

FOREIGN PATENT DOCUMENTS

WO 2004/109996 12/2004
WO WO 2004109996 A1 * 12/2004
WO 2008/088079 7/2008
WO WO 2008088079 A1 * 7/2008

OTHER PUBLICATIONS

European Search Report (in English language) issued Nov. 19, 2010 in corresponding European Patent Application No. 09 25 2735.

* cited by examiner

*Primary Examiner* — Travis Hunnings
(74) *Attorney, Agent, or Firm* — Wenderoth, Lind & Ponack, LLP

(57) ABSTRACT

An alarm system and an alarm device that are capable of enhancing a fail-safe function. A fire alarm device (A) operating as a master unit transmits a switching request signal to fire alarm devices operating as slave units at a predetermined timing. The switching request signal contains at least an own address and an address of a fire alarm device (B) that is to operate as the master unit next (S20). Upon reception of the switching request signal, among the fire alarm devices operating as the slave units, the fire alarm device (B) that is to operate as the master unit next judges whether or not switching is possible based on switching availability judgment information for judging whether or not switching to the master unit is possible (S30), and, when it is judged that switching is possible, starts operating as the master unit (S31).

6 Claims, 6 Drawing Sheets

ALARM SYSTEM AND ALARM DEVICE

BACKGROUND OF THE INVENTION

1. Field of the Invention

The present invention relates to an alarm system including a master alarm device and at least one slave alarm device which are capable of communication with each other.

2. Description of the Related Art

There is provided an alarm device for detecting heat or smoke that is generated in a room or the like and issuing an alarm. Further, there is provided an alarm system including each of such alarm devices provided in respective rooms, in which one of the plurality of alarm devices and others thereof operate as a master unit and slave units, respectively, and perform the alarm operation in synchronization with one another.

As a slave unit used in such an alarm system, there is proposed "a wireless slave unit used in a specified low power two-way wireless communication system including one wireless master unit and a plurality of wireless slave units, for performing two-way wireless communication with an available frequency band being one wave, the wireless slave unit including: means for transmitting a declaration message of "communication start", which declares that communication is to be started, when the communication is started with the wireless master unit in a status where all wireless slave units including the wireless slave unit have no communication with the wireless master unit; means for receiving the declaration message of the "communication start", which declares that the communication has been started, with regard to any one of wireless slave units excluding the wireless slave unit; means for identifying the received declaration message, and immediately shifting the wireless slave unit into a call standby status indicating that the any one of wireless slave units excluding the wireless slave unit is communicating with the wireless master unit; means for transmitting, at a time of finishing the communication with the wireless master unit, a declaration message of "communication end", which declares that the communication with the wireless master unit is finished; means for receiving the declaration message of the "communication end", which declares that the communication is finished, with regard to the any one of wireless slave units excluding the wireless slave unit; and means for identifying the received declaration message, and immediately canceling the call standby status" (for example, see JP 2005-294943 A (p. 4, FIG. 1)).

In an alarm system including a master unit and slave units which are capable of communication with one another, the master unit stores and manages terminal information at the time of addition, replacement, deletion, etc. of a slave unit terminal within the alarm system. At the same time, by transferring to the other slave units an information signal regarding a fire or the like, which has been transmitted from a certain slave unit, the master unit relays the signal. In this manner, the master unit and the slave units within the alarm system perform an alarm operation in synchronization with one another.

However, as the number of slave units constituting the alarm system increases, the frequency of communication performed between the master unit and the slave units increases. Along with this, the number of communication tasks to be processed by the master unit increases, which results in increased current consumption of the master unit. Accordingly, for example, in a case of a master unit powered by a battery, a battery life thereof becomes shorter. With regard to the master unit, by supplying power from an AC power supply, it is possible to operate the master unit without having any concern about the battery level. However, the location where the master unit is installed may be limited depending on the location of the power supply outlet. In addition, the master unit and the slave unit are products of different configurations, and hence a manufacturing process and an inspection process therefor become complicated, resulting in increased workload. Consequently, manufacturing cost becomes higher.

Further, if implementation of the original functions (for example, fire detection, fire alarm, etc.) is given a lower priority due to increase in amount of processing to be executed by the master unit with regard to communication processing, the master unit fails to sufficiently perform a function as the alarm device.

SUMMARY OF THE INVENTION

In order to solve the above-mentioned problems, the present invention has been made, and provides an alarm system and an alarm device which are capable of enhancing a fail-safe function by periodically switching an alarm device operating as a master unit.

An alarm system according to the present invention includes: a master alarm device; and at least one slave alarm device, the master alarm device and the at least one slave alarm device performing transmission and reception therebetween. The master alarm device transmits a switching request signal to the at least one slave alarm device at a predetermined timing, the switching request signal containing at least an own address and an address of a slave alarm device that is to operate as the master alarm device next. Upon reception of the switching request signal, the slave alarm device that is to operate as the master alarm device next judges whether or not switching is possible based on switching availability judgment information for judging whether or not the switching is possible between the slave alarm device and the master alarm device. On this occasion, when it is judged that the switching is possible, the slave alarm device starts operating as the master alarm device. On the other hand, when it is judged that the switching is impossible, the slave alarm device transmits an abnormality signal.

Further, in the alarm system described above, the master alarm device avoids transmitting the switching request signal to the slave alarm device that has transmitted the abnormality signal.

Further, the switching availability judgment information includes information on reduction in battery voltage.

Further, an alarm device according to the present invention includes: a status detection section; a status judgment section for judging a status based on a signal output from the status detection section; a control section for causing an alarm to be output based on a result of the judging made by the status judgment section; a transmitting/receiving section for transmitting and receiving a status signal to and from another alarm device; and an operation setting section for performing setting as to whether the alarm device is to operate as a master alarm device or as a slave alarm device. When the alarm device operates as the master alarm device, the control section transmits a switching request signal to the another alarm device at a predetermined timing via the transmitting/receiving section, the switching request signal containing at least an own address and an address of a slave alarm device that is to operate as the master alarm device next. When the alarm device operates as the slave alarm device, upon reception of the switching request signal, the control section judges whether or not switching is possible based on switching availability judgment information for judging whether or not the switching is possible between the slave alarm device and the master alarm device. On this occasion, when it is judged that the switching is possible, the operation setting section performs the setting so that the alarm device operates as the master alarm device. On the other hand, when it is judged that the switching is impossible, the control section transmits an abnormality signal to the another alarm device via the transmitting/receiving section.

The control section avoids transmitting the switching request signal to the alarm device that has transmitted the abnormality signal.

Further, the switching availability judgment information includes information on reduction in battery voltage.

In the alarm system according to the present invention, the alarm device operating as the master unit is switched when a predetermined period of time has elapsed. Therefore, balanced current consumption among the alarm devices can be achieved, which enables enhancing the fail-safe function of the alarm system.

Further, in the alarm system according to the present invention, a slave unit that is judged as being inappropriate for the switching of the master unit does not take over as the master unit. Therefore, an appropriate slave unit can take over as the master unit.

Further, in the alarm system according to the present invention, based on the information on reduction in battery voltage, it is judged whether or not a takeover of the master unit is possible. Therefore, an alarm device whose battery level is low does not take over as the master unit, which enables enhancing the fail-safe function of the alarm system.

Further, with the alarm device according to the present invention, it is possible to selectively set whether the alarm device is to operate as the master unit or as the slave unit. Therefore, in a case where the present invention is applied to an alarm system including a plurality of alarm devices, the fail-safe function of the alarm system can be enhanced.

Further, with the alarm device according to the present invention, an alarm device in an abnormal status is not selected as the alarm device that is to operate as the master unit. Therefore, in the case where the present invention is applied to an alarm system including a plurality of alarm devices, an appropriate slave unit can take over as the master unit.

Further, with the alarm device according to the present invention, whether or not the alarm device can operate as the master unit is judged based on the battery voltage. Therefore, in the case where the present invention is applied to an alarm system including a plurality of alarm devices, the fail-safe function of the alarm system can be enhanced.

DETAILED DESCRIPTION OF THE PREFERRED EMBODIMENT

Embodiment

Hereinbelow, in an embodiment of the present invention, description is given by taking as an example a case where the present invention is applied to an alarm system including a plurality of fire alarm devices that are powered by a battery and perform wireless communication.

Figure 1:
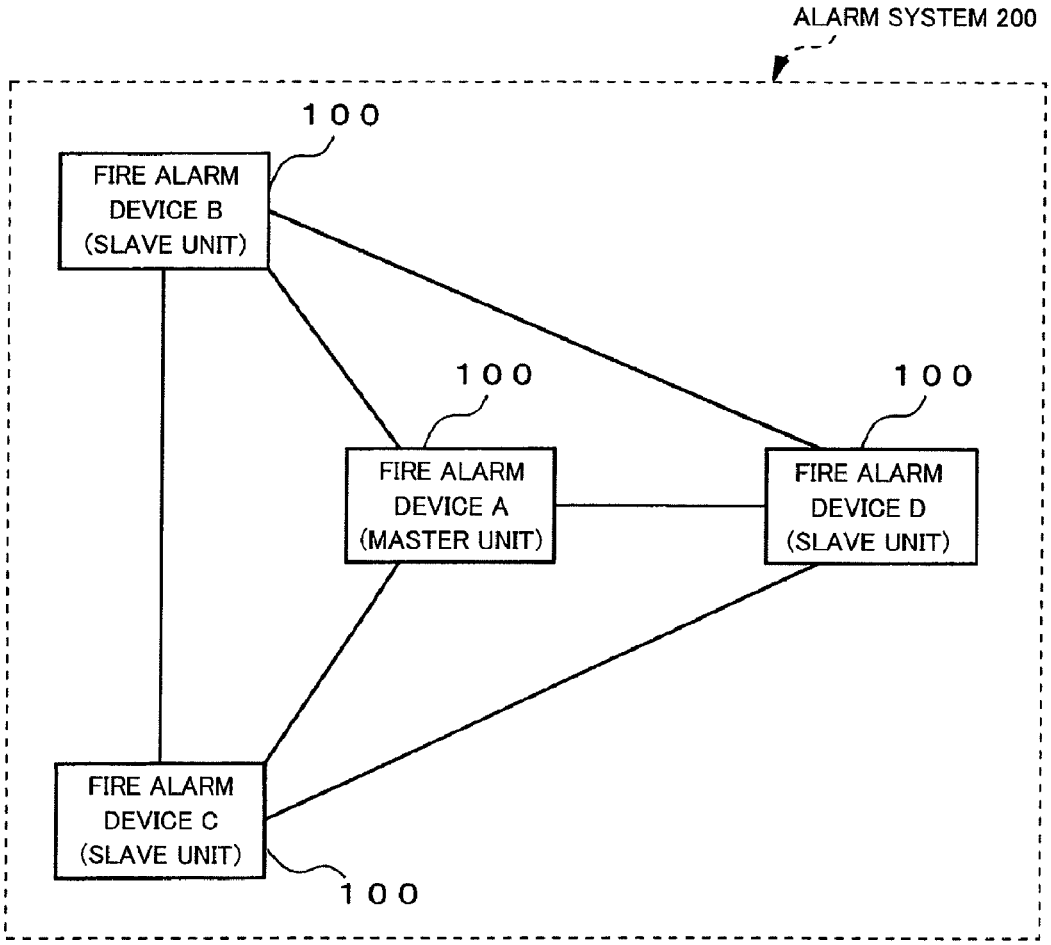
FIG. 1 is a configuration diagram of an alarm system according to an embodiment of the present invention.

FIG. 1 is a diagram illustrating a configuration of an alarm system 200 according to the embodiment of the present invention. The alarm system 200 includes a plurality of fire alarm devices 100. Each of the plurality of fire alarm devices 100 has a function of detecting a fire, and also has a function of issuing an alarm independently.

As described below, all the fire alarm devices 100 have the same configuration, and are capable of operating as both a master unit and a slave unit depending on setting of an operation setting section. It should be noted that, in order to distinguish the fire alarm devices 100 from one another, the fire alarm devices 100 may be referred to as a fire alarm device A, a fire alarm device B, a fire alarm device C, and a fire alarm device D, respectively. Here, the fire alarm devices A to D belong to the same one group. Further, in FIG. 1, solid lines connecting the fire alarm devices 100 show that the fire alarm devices 100 are capable of communicating with each other through wireless communication.

Figure 2:
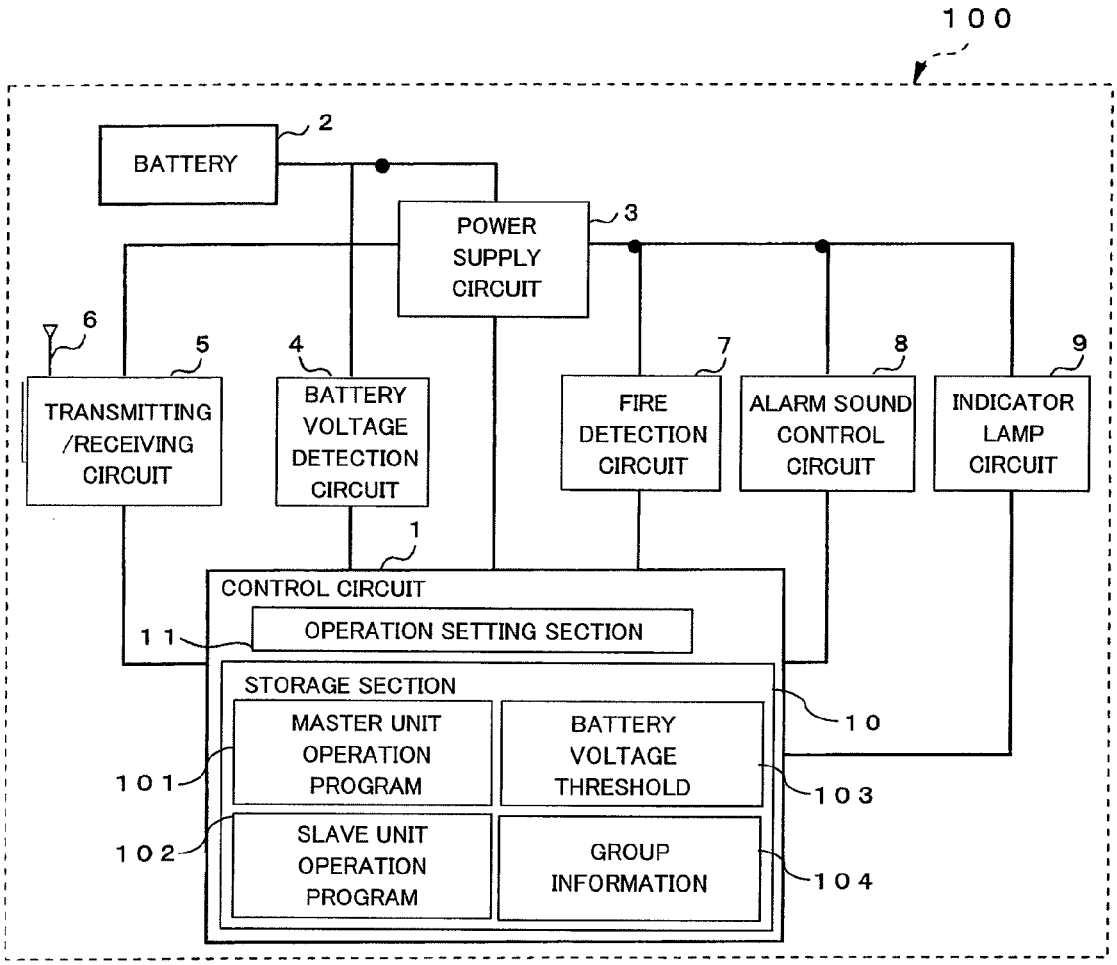
FIG. 2 is a functional block diagram of an alarm device according to the embodiment of the present invention.
Figure 3:
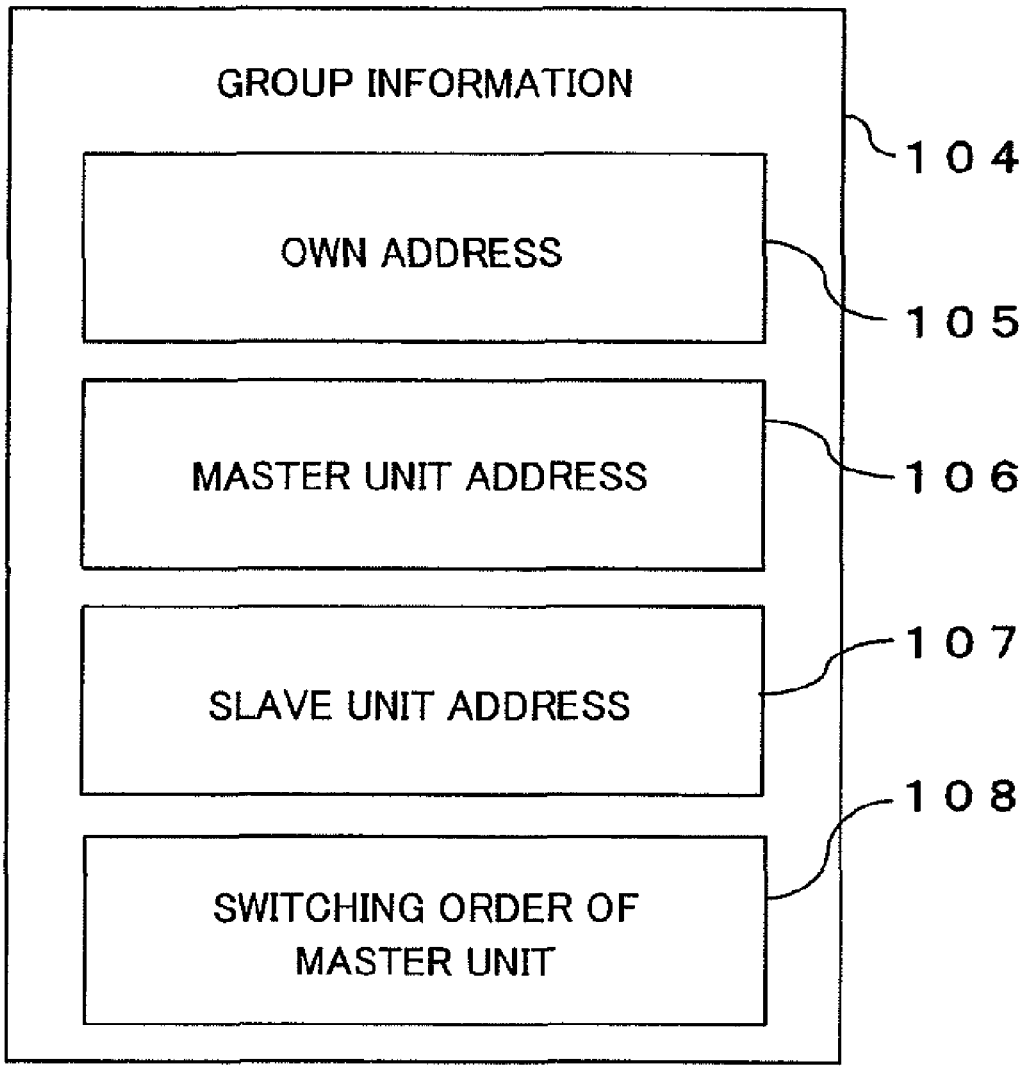
FIG. 3 is a block diagram illustrating a structure of group information.

FIG. 2 is a functional block diagram illustrating a main configuration of the fire alarm device 100 according to the embodiment of the present invention.

In FIG. 2, the fire alarm device 100 includes a control circuit 1, a battery 2, a power supply circuit 3, a battery voltage detection circuit 4, a transmitting/receiving circuit 5, an antenna 6, a fire detection circuit 7, an alarm sound control circuit 8, and an indicator lamp circuit 9.

The battery 2 supplies DC power to the power supply circuit 3. The power supply circuit 3 controls the voltage of the battery 2 to a predetermined voltage, and then supplies the predetermined voltage to the control circuit 1, the transmitting/receiving circuit 5, the fire detection circuit 7, the alarm sound control circuit 8, and the indicator lamp circuit 9.

The battery voltage detection circuit 4 detects the voltage of the battery 2 which is applied to the power supply circuit 3, and then outputs, to the control circuit 1, a battery voltage detection signal corresponding to the detected voltage. When it is detected that the level of the battery 2 has declined or fallen below a threshold for battery exhaustion, the battery voltage detection circuit 4 activates the alarm sound control circuit 8 and the indicator lamp circuit 9, and also causes the transmitting/receiving circuit 5 to output a status signal containing battery exhaustion status information under the control of the control circuit 1.

The fire detection circuit 7 corresponds to a status detection section of the present invention. The fire detection circuit 7 detects a physical quantity or physical change of a detection subject, such as smoke or heat, which is generated by a fire phenomenon, and then outputs a signal corresponding to a detection content to the control circuit 1. The alarm sound control circuit 8 is a circuit for controlling an operation of sounding an alarm, which is performed by a buzzer, a speaker, or the like. The indicator lamp circuit 9 is a circuit for controlling an operation of turning on an indicator lamp such as an LED.

The transmitting/receiving circuit 5 is connected to the antenna 6 for transmitting and receiving radio signals. The transmitting/receiving circuit 5 processes a radio signal input via the antenna 6. Then, when the signal is directed to its own device, the transmitting/receiving circuit 5 performs reception processing. On the other hand, when the signal is not directed to its own device, the transmitting/receiving circuit 5 does not perform the reception processing. The signal subjected to the reception processing is output to the control circuit 1. Further, the transmitting/receiving circuit 5 is controlled by the control circuit 1, and performs transmission processing for a signal such as the status signal.

Based on a signal output by the fire detection circuit 7, the control circuit 1 controls the alarm sound control circuit 8 and the indicator lamp circuit 9, to thereby issue an alarm by means of the sound and the indicator lamp and stop the alarm. Further, while performing necessary processing based on a signal received by the transmitting/receiving circuit 5, the control circuit 1 controls the transmitting/receiving circuit 5 if necessary, to thereby transmit a signal such as the status signal to another fire alarm device. It should be noted that a status judgment section of the present invention corresponds to the control circuit 1 in this embodiment.

Further, the control circuit 1 includes an operation setting section 11. The operation setting section 11 has a function of performing setting as to whether the fire alarm device 100 is to operate as the master unit or the slave unit. Depending on the setting of the operation setting section 11, the control circuit 1 controls operation of each component based on a program stored in a storage section 10 described below so that the fire alarm device 100 operates as the master unit or the slave unit.

The storage section 10 contains a master unit operation program 101, which is a control program used in the case where the fire alarm device 100 is to operate as the master unit, and a slave unit operation program 102, which is a control program used in the case where the fire alarm device 100 is to operate as the slave unit. Depending on the setting of the operation setting section 11, the control circuit 1 performs operation control based on the master unit operation program 101 or the slave unit operation program 102. In other words, the fire alarm device 100 is capable of operating as both the master unit and the slave unit.

In addition, the storage section 10 contains a battery voltage threshold 103 and group information 104.

As the battery voltage threshold 103, a threshold for making judgment on the battery voltage detected by the battery voltage detection circuit 4 is stored. It should be noted that switching availability judgment information of the present invention corresponds to the battery voltage threshold 103 in this embodiment.

As the group information 104, various kinds of information regarding an own device and a group to which the own device belongs are stored.

The group information 104 contains an own address 105, a master unit address 106, a slave unit address 107, and a switching order of master unit 108. Further, the group information 104 also contains a group ID (not shown) for identifying a group.

The own address 105 is address information uniquely given to each of the fire alarm devices 100 of the alarm system 200. In this example, the description is given by referring to the addresses of the fire alarm devices A to D as, for example, addresses A to D, respectively.

The master unit address 106 corresponds to the own address 105 of the fire alarm device 100 operating as the master unit in the alarm system 200. In the example of FIG. 1, all the fire alarm devices 100 store, as the master unit address 106, the address A corresponding to the own address 105 of the fire alarm device A.

The slave unit address 107 corresponds to the own address 105 of each of the other fire alarm devices 100 excluding the own device among the fire alarm devices 100 operating as the slave unit in the alarm system 200. In the example of FIG. 1, the fire alarm device B stores, as the slave unit address 107, the address C and the address D excluding the address B.

The switching order of master unit 108 is information indicating an order of the fire alarm devices A to D which is used in switching the master unit. The switching order of master unit 108 may be determined arbitrarily. For example, the order in which the fire alarm devices 100 are added to the alarm system 200 may be set as the switching order of master unit 108.

It should be noted that at least the master unit address 106, the slave unit address 107, and the switching order of master unit 108 are rewritable.

A plurality of the fire alarm devices 100 thus configured constitute one group, in which one device operates as the master unit and the other devices operate as the slave unit. Setting as the master unit is performed by, for example, depressing a registration button (switch, not shown) after power-on. On the other hand, setting as the slave unit is performed by, for example, depressing the registration button (switch, not shown) of the master unit to enter into a registration mode, and depressing the registration button (switch not shown) after the power-on of the slave unit. At the time of the setting as the master unit or the slave unit as described above, the fire alarm device 100 performs wireless communication to store the group information 104, and also uses the operation setting section 11 to perform the setting.

Next, description is given of an operation performed when a fire has occurred in the alarm system 200.

When a fire has occurred in an environment where the fire alarm device A serving as the master unit is installed, the fire alarm device A detects a fire with the fire detection circuit 7 to issue an alarm by means of the sound or the indicator lamp, and also transmits, as a interlock signal, information regarding the fire to the other slave units (fire alarm devices B to D). Then, the slave units (fire alarm devices B to D) that have received the interlock signal transmitted by the master unit (fire alarm device A) issue a necessary alarm by means of the sound or the indicator lamp. After that, if the master unit (fire alarm device A) has ceased detecting the fire, the master unit carries out self-restoration to stop the alarm, and also stops transmitting the interlock signal to the other slave units (fire alarm devices B to D). Then, the other slave units (fire alarm devices B to D), which no longer receive the interlock signal, stop the alarm as well.

On the other hand, when a fire has occurred in an environment where the fire alarm device B serving as the slave unit is installed, the fire alarm device B detects a fire with the fire detection circuit 7 to issue an alarm by means of the sound or the indicator lamp, and also transmits, as a interlock signal, information regarding the fire to the master unit (fire alarm device A) and the other slave units (fire alarm devices C and D). Then, the master unit (fire alarm device A) and the other slave units (fire alarm devices C and D) that have received the interlock signal transmitted by the fire alarm device B issue a necessary alarm by means of the sound or the indicator lamp.

Further, the master unit (fire alarm device A), which has received the interlock signal issued by the fire alarm device B serving as the slave unit, transfers the interlock signal to other slave units (fire alarm devices C and D) than the fire alarm device B serving as a transmission source. As a result, even if the slave units (fire alarm devices B to D) are located away from one another and hence the fire alarm devices C and D fail to receive the interlock signal transmitted by the fire alarm device B, the fire alarm devices C and D can receive the interlock signal transferred by the master unit (fire alarm device A). After that, if the fire alarm device B has ceased detecting the fire, the fire alarm device B carries out self-restoration to stop the alarm, and also stops transmitting the interlock signal to the master unit (fire alarm device A) and the other slave units (fire alarm devices C and D). Then, the master unit (fire alarm device A) and the slave units (fire alarm devices C and D), which no longer receive the interlock signal, stop the alarm as well. In this manner, the master unit (fire alarm device A) and the slave units (fire alarm devices B to D) perform an alarm operation in synchronization with one another, and hence it is possible to deliver the alarm to a user more reliably.

Further, in the alarm system 200, in order to check the status of each of the fire alarm devices 100, periodical transmission for status check is performed during fire monitoring (normal status). In the periodical transmission, at a predetermined transmission timing, the master unit (fire alarm device A) transmits a status signal to the slave units (fire alarm devices B to D). The status signal contains status information on the master unit (fire alarm device A) or on a group to which the master unit belongs, and information containing the own address 105 for identifying the transmission source. This status signal may be repeatedly transmitted a predetermined number of times. With this configuration, a probability of normal reception by the slave units (fire alarm devices B to D) can be increased.

When the slave units (fire alarm devices B to D) have received the status signal from the master unit (fire alarm device A), for example, the slave units transmit, as the status signal, the status information regarding the own device and information containing the own address 105 for identifying the transmission source, to the master unit (fire alarm device A).

On this occasion, the master unit (fire alarm device A) and the slave units (fire alarm devices B to D) use the own addresses 105 contained in the respective status signals to make a distinction as to which fire alarm device has transmitted the signal. As examples of the status information regarding the master unit and the slave units (fire alarm devices A to D), there are enumerated the battery level, a sensor status (degradation, contamination, etc.) of the fire detection circuit 7, and the number of times the reception processing has been performed (number of times processing for irregular radio has been performed). Further, as examples of the status information regarding the group, there are enumerated an address or a group ID of a slave unit that is suffering an abnormality, and an address or a group ID of a slave unit for which wireless communication is not established.

In the alarm system 200 including the fire alarm devices 100 thus configured, the fire alarm device 100 operating as the master unit is switched when a predetermined period of time has elapsed. In switching the master unit, when a master unit switching timing has been reached, a current master unit selects a slave unit that is to become a next master unit according to the order stored as the switching order of master unit 108, and then transmits, to all the slave units, information regarding the current master unit and information regarding the slave unit that is to become the next master unit. Then, the slave unit that is to become the next master unit judges whether or not the switching of the master unit is possible based on the switching availability judgment information, and transmits, as a response, a result of the judgment to the master unit and the other slave units. If the switching of the master unit is possible, the slave unit that is to become the next master unit performs the switching. If the switching is impossible, the slave unit that is to become the next master unit transmits an abnormality signal to the current master unit and the other slave units. It should be noted that in a case where the switching of the master unit has failed, the current master unit makes an attempt to switch the master unit again with respect to another slave unit according to the switching order of master unit 108. In this manner, the switching of the master unit is performed at predetermined time intervals.

Figure 4:
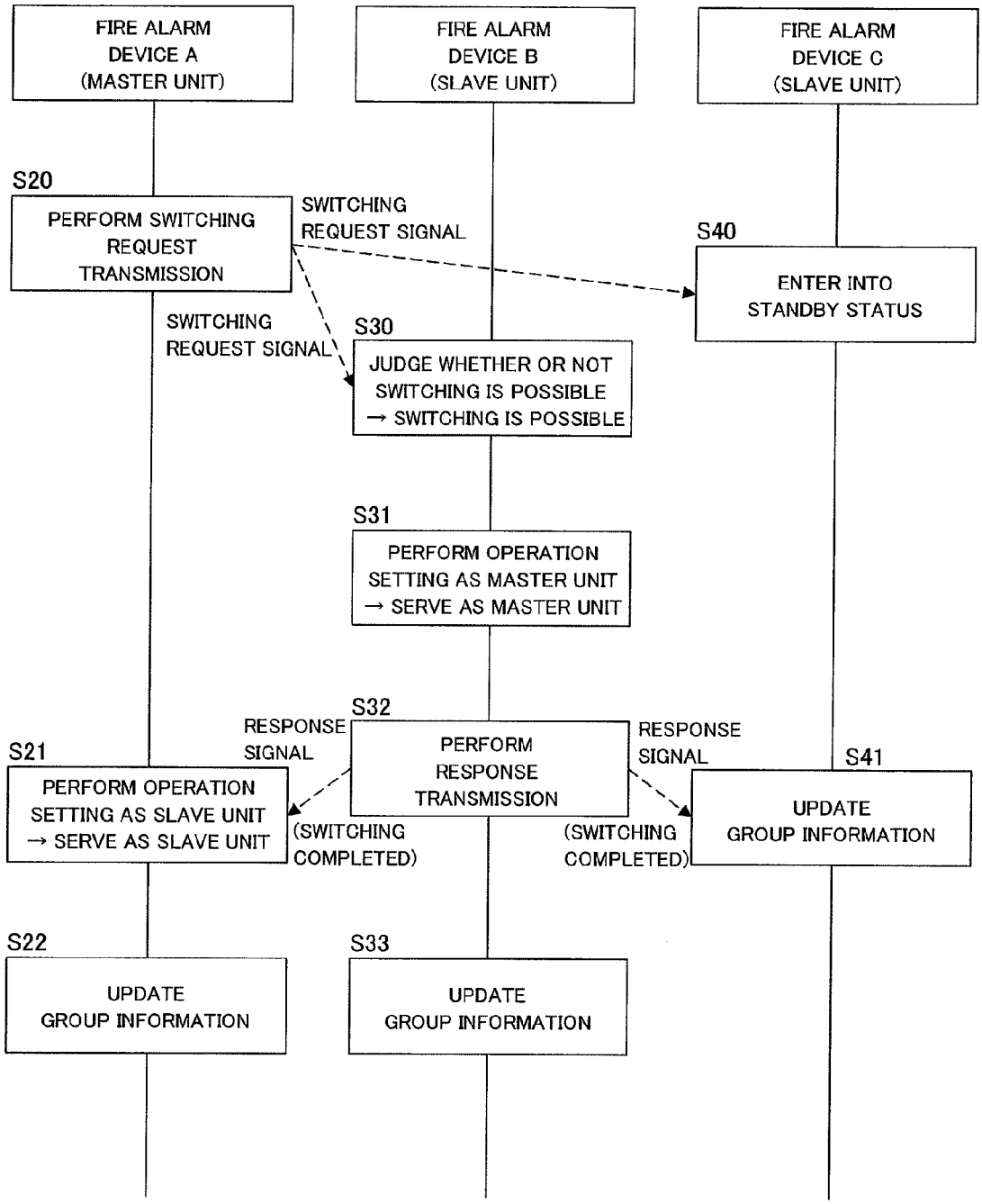
FIG. 4 is a diagram illustrating a flow of an operation performed in a case where switching of a master unit is successful.
Figure 5:
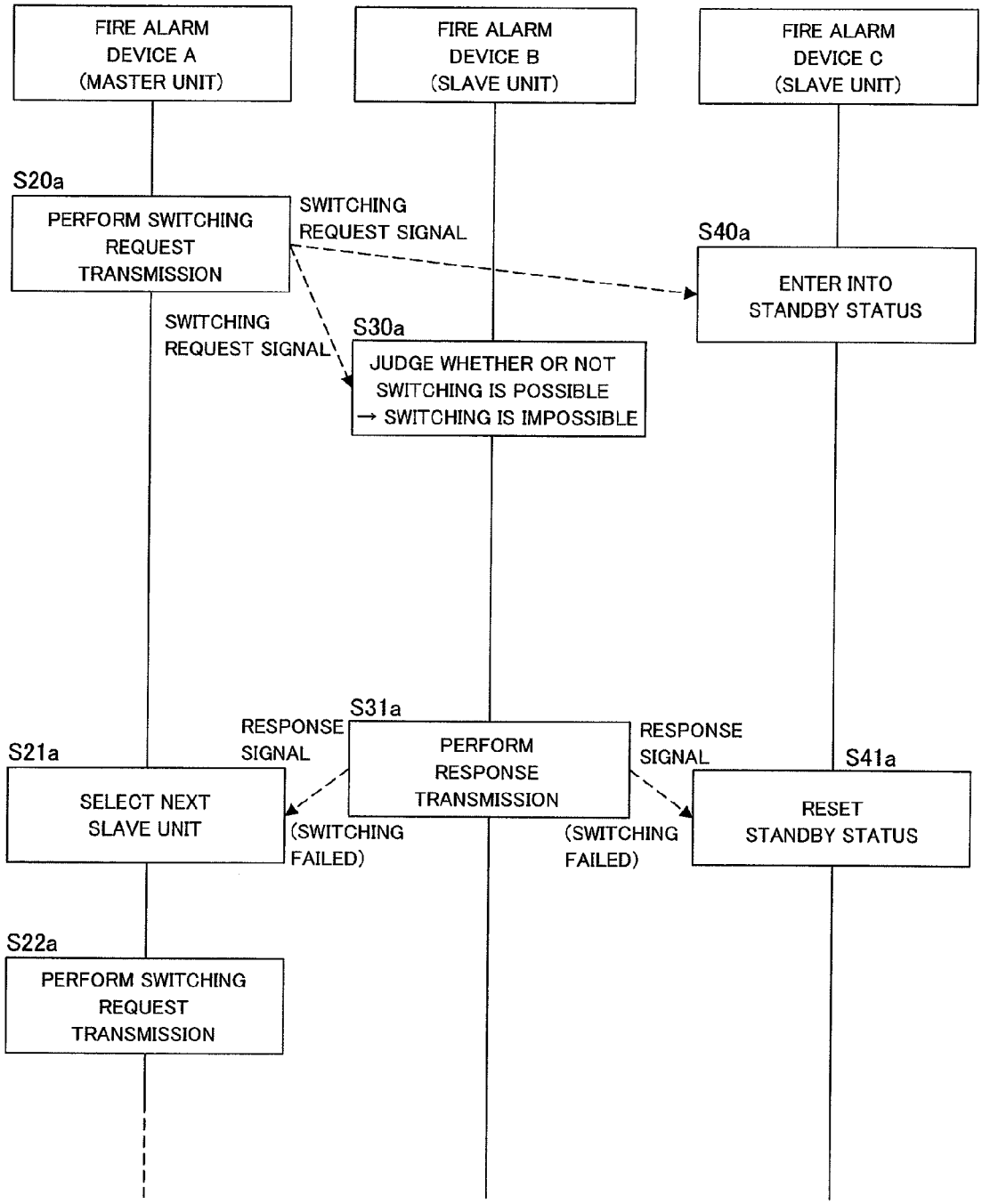
FIG. 5 is a diagram illustrating a flow of an operation performed in a case where the switching of the master unit fails.
Figure 6:
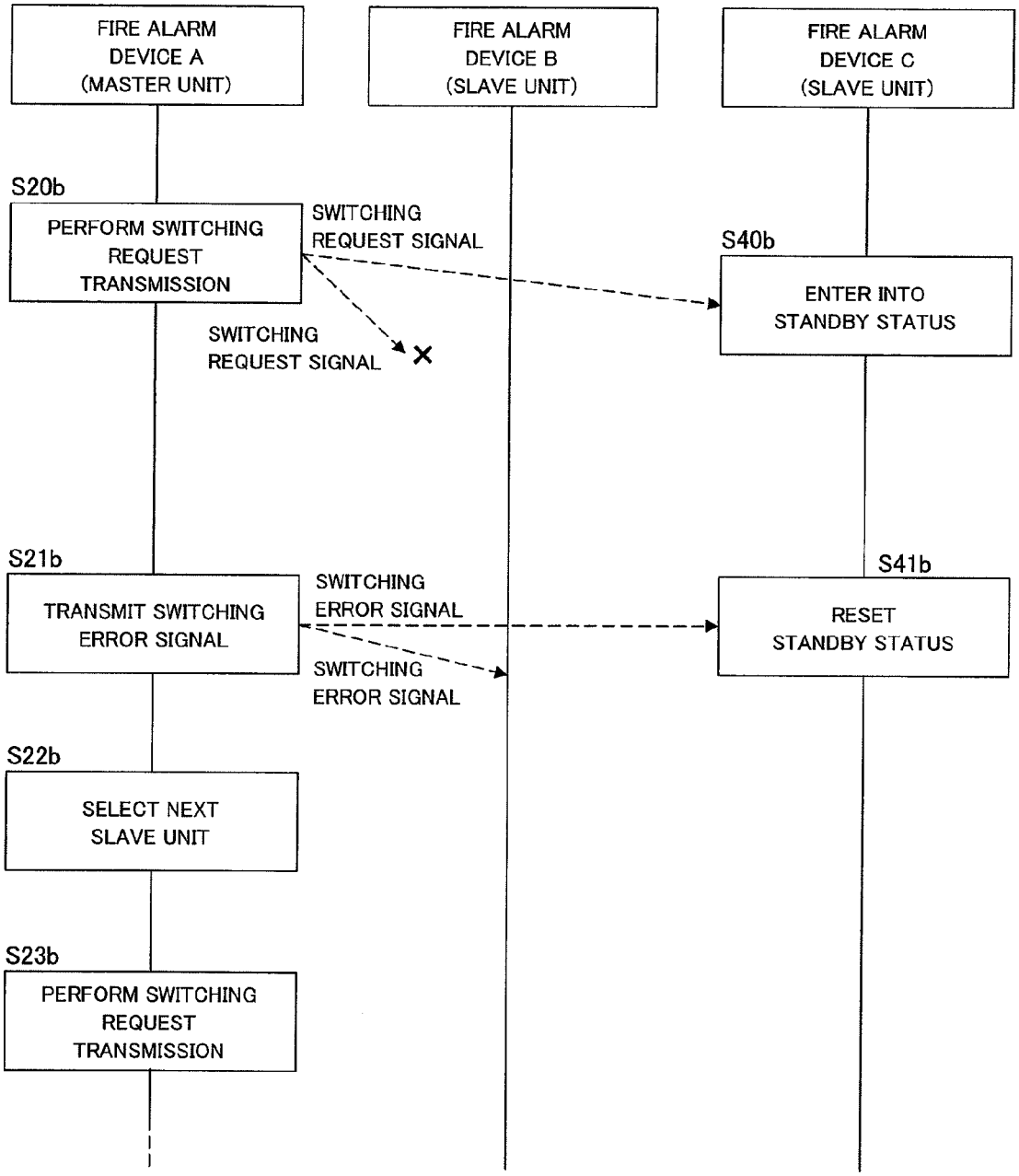
FIG. 6 is a diagram illustrating a flow of another operation performed in the case where the switching of the master unit fails.

Referring to FIGS. 4 to 6, description is given of operations performed when the master unit is switched. FIGS. 4 to 6 are diagrams each illustrating a flow of an operation performed when the master unit is switched from the master unit (fire alarm device A) to the slave unit (fire alarm device B). FIG. 4 is a diagram illustrating a case where the switching of the master unit from the master unit (fire alarm device A) to the slave unit (fire alarm device B) is performed normally. FIGS. 5 and 6 are diagrams each illustrating a case where the switching of the master unit from the master unit (fire alarm device A) to the slave unit (fire alarm device B) fails. It should be noted that because the fire alarm device C and the fire alarm device D perform the same operation, FIGS. 4 to 6 illustrate only the fire alarm device C. Further, in this example, description is given by taking as an example a case where the switching order of master unit 108 is set in order of the fire alarm device A, the fire alarm device B, the fire alarm device C, and the fire alarm device D.

Referring to FIG. 4, description is given of the operation performed when the switching of the master unit is performed normally.

(S20)

First, the master unit (fire alarm device A) transmits a request signal for switching the master unit to all the slave units (fire alarm devices B to D) belonging to the same group (alarm system 200). The switching request signal contains the address A, which is the own address 105 of the master unit (fire alarm device A), and the address B, which is the own address 105 of the fire alarm device B, as the information on the current master unit and the information on the next master unit, respectively. Further, switching request transmission is performed at a predetermined master unit switching timing. As the master unit switching timing, an arbitrary periodical timing may be set, such as every predetermined time interval or at predetermined time points. The transmission timing determined for the operation of the above-mentioned periodical transmission and the master unit switching timing may be made coincide with each other.

(S30)

The slave unit (fire alarm device B) which is to become the master unit next and has the address B set as the own address 105 receives the request signal for switching the master unit, and then judges whether or not the switching of the master unit is possible. In the judgment, it is checked whether or not the battery voltage detected by the battery voltage detection circuit 4 is larger than the battery voltage threshold 103 stored in the storage section 10. When the battery voltage is larger than the battery voltage threshold 103, it is judged that the switching of the master unit is possible. On the other hand, when the battery voltage is equal to or smaller than the battery voltage threshold 103, it is judged that the switching of the master unit is impossible. It should be noted that, as the battery voltage threshold 103, there is set a value indicating a battery level high enough for the fire alarm device 100 to operate as the master unit until the next master unit switching timing.

(S31)

Next, the fire alarm device B performs operation setting as the master unit. Specifically, the operation setting section 11 performs setting so that the fire alarm device B operates as the master unit, and the control circuit 1 starts the operation control according to the master unit operation program 101.

(S32)

Next, the fire alarm device B transmits, as response transmission, a response signal in response to the switching request transmission, to the fire alarm device A and the other slave units (fire alarm devices C and D). The response signal contains a signal indicating that the switching of the master unit has been completed. Because the fire alarm device B has the master unit address 106 and the slave unit addresses 107 stored as the group information 104, the fire alarm device B can transmit the response signal to all the fire alarm devices 100 within the group.

(S33)

Next, the fire alarm device B updates the group information 104. In this processing, the fire alarm device B stores the address B as the master unit address 106, and also stores the address A, the address C, and the address D as the slave unit addresses 107. In other words, the address A of the fire alarm device A, which has been the master unit before the switching, is additionally stored as the slave unit address 107.

(S21)

When the fire alarm device A has received the response signal indicating that the switching of the master unit has been completed, the fire alarm device A performs operation setting as the slave unit. Specifically, the operation setting section 11 performs setting so that the fire alarm device A operates as the slave unit, and the control circuit 1 starts the operation control according to the slave unit operation program 102.

(S22)

Next, the fire alarm device A updates the group information 104. In this processing, the fire alarm device A stores the address of the fire alarm device B as the master unit address 106, and also stores the addresses of the fire alarm device C and the fire alarm device D as the slave unit addresses 107. In other words, the address B of the fire alarm device B, which is the master unit after the switching, is deleted from the slave unit addresses 107.

(S40)

On the other hand, the slave unit (fire alarm device C) which does not have the address B for the next master unit set as the own address 105 receives the switching request signal transmitted by the fire alarm device A to recognize that the switching of the master unit is performed from the fire alarm device A to the fire alarm device B, and enters into a standby status for reception of a signal regarding the switching of the master unit.

(S41)

Then, when the fire alarm device C has received, from the fire alarm device B, the response signal indicating that the switching of the master unit has been completed, the fire alarm device C updates the group information 104. In this processing, the fire alarm device C sets the address B as the master unit address 106, and also additionally stores the address A as the slave unit address 107. For example, the fire alarm device C stores the address A and the address D as the slave unit addresses 107.

Next, referring to FIG. 5, description is given of the operation performed when the switching of the master unit fails. In FIG. 5, description is given of a case where the fire alarm device B that is to become the next master unit judges that the switching of the master unit is impossible.

(S20*a*)

First, the master unit (fire alarm device A) transmits a request signal for switching the master unit to all the slave units (fire alarm devices B to D). This processing is the same as that of Step S20 described above with reference to FIG. 4.

(S30*a*)

The slave unit (fire alarm device B) which is to become the master unit next and has the address B set as the own address 105 judges whether or not the switching of the master unit is possible. Assume that the battery voltage detected by the battery voltage detection circuit 4 is equal to or smaller than the battery voltage threshold 103 stored in the storage section 10, and hence it is judged that the switching of the master unit is impossible.

(S31*a*)

Next, the fire alarm device B transmits a response signal in response to the switching request transmission, to the fire alarm device A and the other slave units (fire alarm devices C and D). The response signal contains a signal indicating that the switching of the master unit from the fire alarm device A to the fire alarm device B has failed.

(S21*a*)

When the fire alarm device A has received the response signal indicating that the switching of the master unit has failed, the fire alarm device A refers to the switching order of master unit 108, to thereby select a fire alarm device (in this example, fire alarm device C) that is to become the master unit next instead of the fire alarm device B.

(S22*a*)

Next, the fire alarm device A attempts to switch the master unit by performing the switching request transmission that specifies the fire alarm device C as the next master unit (containing the address A of the current master unit and the address C of the next master unit). The subsequent processing is the same as described above.

(S40*a*)

The slave unit (fire alarm device C) which does not have the address B for the next master unit set as the own address 105 receives the switching request signal transmitted by the fire alarm device A to recognize that the switching of the master unit is performed from the fire alarm device A to the fire alarm device B, and then enters into the standby status for reception of a signal regarding the switching of the master unit.

(S41*a*)

Then, when the fire alarm device C has received the response signal indicating that the switching of the master unit has failed, the fire alarm device C resets the standby status, and returns to a status of before the reception of the switching request signal.

Next, referring to FIG. 6, description is given of another operation performed when the switching of the master unit fails. In FIG. 6, description is given of a case where the slave unit (fire alarm device B) that is to become the next master unit has not received the switching request signal transmitted by the master unit, for a certain reason such as a communication abnormality.

(S20*b*)

First, the master unit (fire alarm device A) transmits a request signal for switching the master unit to all the slave units (fire alarm devices B to D). This processing is the same as that of Step S20 described above with reference to FIG. 4. Here, there occurs a communication abnormality due to, for example, interference, preventing the fire alarm device B from receiving the switching request signal.

Because the fire alarm device B which is to become the next master unit and has the address B set as the own address 105 has not received the switching request signal, the fire alarm device B continues a normal monitoring status, and does not perform the processing of judging whether or not the switching of the master unit is possible.

(S21*b*)

In a case where the master unit (fire alarm device A) does not receive the response signal from the fire alarm device B until a predetermined period of time elapses after the switching request transmission, the fire alarm device A judges that the switching of the master unit has failed, and then transmits a switching error signal to all the slave units.

(S22*b*)

Then, the fire alarm device A refers to the switching order of master unit 108, to thereby identify a fire alarm device (in this example, fire alarm device C) that is to become the master unit next instead of the fire alarm device B.

(S23*b*)

Next, the fire alarm device A performs the switching request transmission that specifies the fire alarm device C as the next master unit. The subsequent processing is the same as described above.

(S40*b*)

Meanwhile, the slave unit (fire alarm device C) which does not have the address B for the next master unit set as the own address 105 receives the switching request signal transmitted by the fire alarm device A to recognize that the switching of the master unit is performed from the fire alarm device A to the fire alarm device B, and then enters into the standby status for reception of a signal regarding the switching of the master unit.

(S41*b*)

Then, when the fire alarm device C has received the switching error signal, the fire alarm device C resets the standby status, and returns to a status of before the reception of the switching request signal.

Here, when the switching of the master unit has failed, it is judged that a certain abnormality has occurred in the fire alarm device B, which allows the master unit (fire alarm device A) to issue a certain alarm. With this configuration, it becomes possible to prompt the user to inspect the fire alarm device B. Then, with regard to the slave unit that has failed in the switching of the master unit (fire alarm device B in the examples of FIG. 5 and FIG. 6), each of the fire alarm devices 100 stores that slave unit as a "switching impossible" slave unit in the switching order of master unit 108, and the switching of the master unit is not performed with respect to the fire alarm device B. Then, if the switching of the master unit has become possible due to replacement of the battery or the like, the fire alarm device B is added to the switching order of master unit 108.

As described above, according to this embodiment, the fire alarm device 100 switches the master unit at the predetermined timing. As described above, because the master unit manages terminal information within the alarm system and relays signals, the master unit has larger current consumption than the slave unit. However, in this embodiment, by switching the master unit in turn, it can be avoided that the battery life of a particular fire alarm device 100 becomes shorter, which prevents unbalanced battery lives. For example, in a case where a particular fire alarm device is caused to constantly operate as the master unit, because the battery life of the master unit is shorter, the master unit requires more frequent replacement of the battery than the other slave units. Because no master unit exists during the replacement of the battery, the alarm system 200 cannot operate as a system, making impossible an alarm synchronization operation. However, with the fire alarm device 100 and the alarm system 200 according to this embodiment, it is possible to prevent the alarm system 200 from suffering a system failure caused by a lowered battery level of the master unit, which enables the alarm system 200 to enhance a fail-safe function.

Further, in this embodiment, the master unit is switched at the periodical timing, such as every predetermined time interval or at predetermined time points. Therefore, time lengths in which the respective fire alarm devices 100 operate as the master unit are made uniform, which enables preventing unbalanced battery lives among the fire alarm devices 100.

Further, according to this embodiment, the fire alarm device 100 is capable of operating as both the master unit and the slave unit. Therefore, there is no need to manufacture fire alarm devices that have different specifications depending on whether the device is the master unit or the slave unit. As a result, by sharing the manufacturing process and the inspection process, manufacturing cost can be suppressed.

Here, in this embodiment, the description has been given by taking as an example the case where the switching of the master unit is performed at the periodical timing, but the present invention may be combined with another configuration so that the switching of the master unit is performed at another timing. For example, if an abnormality has occurred when a fire alarm device is functioning as the master unit, such as the battery voltage having decreased to be equal to or smaller than a predetermined value, the switching of the master unit may be performed. By doing so, it becomes possible to prevent the alarm system 200 from suffering a system failure caused by a lowered battery level of the master unit.

Further, in this embodiment, the description has been given by taking as an example the case where the battery voltage threshold 103 is used as the switching availability judgment information, but the present invention is not limited thereto. For example, the electric field intensity of radio waves may be measured to use a value of the electric field intensity as the switching availability judgment information. Further, the electric field intensity and the battery level may be used in combination.

Further, in this embodiment, the description has been given by taking as an example the case where the switching order of master unit 108 is set arbitrarily in advance, but the order may be changed dynamically. For example, the master unit may acquire the values of the battery levels from the slave units in advance, to thereby set a fire alarm device having a higher battery level as the next master unit. With this configuration, it is possible to prevent the fire alarm devices from having unbalanced battery levels thereamong.

Here, in the above description, the description has been given by taking as an example the case where the present invention is applied to the alarm system including the fire alarm devices that are powered by the battery and perform wireless communication, but the present invention does not limit a power supply method or a communication method of the fire alarm device. Further, apart from the fire alarm device, the present invention is also applicable to an alarm device for abnormality detection or the like.

What is claimed is:

1. An alarm system, comprising:

a master alarm device; and at least one slave alarm device, the master alarm device and the at least one slave alarm device all having an identical configuration and performing transmission and reception therebetween, wherein:

the master alarm device and the at least one slave alarm device store group information containing at least a master alarm device address and a slave alarm device address, and store a master unit switching order which is information predetermining the order of switching the master unit for all alarm devices, the master alarm device determines which slave alarm device is to next operate as the master alarm device based on the master unit switching order, and transmits a switching request signal to all slave alarm devices at a predetermined timing, the switching request signal containing at least an own address and an address of the slave alarm device that is to operate as the master alarm device next;

upon reception of the switching request signal, the slave alarm device that is to operate as the master alarm device next judges whether or not switching is possible based on switching availability judgment information for judging whether or not the switching is possible between the slave alarm device and the master alarm device, and transmits, as a response, a result of the judgment to the master alarm device and all the other slave alarm devices, and when it is judged that the switching is possible, starts operating as the master alarm device; and the master alarm device and all the other slave alarm devices update the group information when they have received a response to the result of the judgment from the slave alarm device.

2. An alarm system according to claim 1, wherein, upon reception of the switching request signal, the slave alarm device that is to operate as the master alarm device next judges whether or not switching is possible based on switching availability judgment information for judging whether or not the switching is possible between the slave alarm device and the master alarm device, and, when it is judged that the switching is impossible, transmits an abnormality signal to the master alarm device.

3. An alarm system according to claim 2, wherein the master alarm device avoids transmitting the switching request signal to the slave alarm device that has transmitted the abnormality signal.

4. An alarm system according to claim 1, wherein at least one of the alarm devices comprises:

a status detection section;

a status judgment section for judging a status based on a signal output from the status detection section;

a control section for causing an alarm to be output based on a result of the judging made by the status judgment section;

a transmitting/receiving section for transmitting and receiving a status signal to and from another alarm device; and an operation setting section for performing setting as to whether the alarm device is to operate as a master alarm device or as a slave alarm device, wherein:

when the alarm device operates as the master alarm device, the control section transmits a switching request signal to the another alarm device at a predetermined timing via the transmitting/receiving section, the switching request signal containing at least an own address and an address of the one of the slave alarm devices that is to operate as the master alarm device next; and when the alarm device operates as the slave alarm device, upon reception of the switching request signal, the control section judges whether or not switching is possible based on switching availability judgment information for judging whether or not the switching is possible between the slave alarm device and the master alarm device, and, when it is judged that the switching is possible, the operation setting section performs the setting so that the alarm device operates as the master alarm device.

5. An alarm system according to claim 4, wherein, when the alarm device operates as the slave alarm device, upon reception of the switching request signal, the control section judges whether or not switching is possible based on switching availability judgment information for judging whether or not the switching is possible between the slave alarm device and the master alarm device, and, when it is judged that the switching is impossible, transmits an abnormality signal to the another alarm device via the transmitting/receiving section.

6. An alarm system according to claim 5, wherein the control section avoids transmitting the switching request signal to the alarm device that has transmitted the abnormality signal.

* * * * *